United States Patent [19]

Van Wyk

[11] Patent Number: 4,991,512

[45] Date of Patent: Feb. 12, 1991

[54] MOISTURE SEAL SHOTSHELLS

[75] Inventor: Rodney Van Wyk, Alton, Ill.

[73] Assignee: Olin Corporation, Stamford, Conn.

[21] Appl. No.: 431,509

[22] Filed: Nov. 3, 1989

[51] Int. Cl.[5] ..... F42B 7/12

[52] U.S. Cl. ..... 102/462; 102/463; 102/466

[58] Field of Search ..... 102/462, 463, 452, 456, 102/448, 466, 467

[56] References Cited

U.S. PATENT DOCUMENTS

| | | | |
|---|---|---|---|
| 2,242,907 | 5/1941 | Finlay et al. | 102/463 |
| 2,300,367 | 10/1942 | Harmon | 102/463 |
| 2,300,368 | 10/1942 | Harmon | 102/463 |
| 2,336,065 | 12/1943 | Cadham | 102/463 |
| 2,373,554 | 4/1945 | Finlay | 102/463 |
| 2,387,665 | 10/1945 | Langkammerer | 102/463 |
| 2,393,987 | 2/1946 | Harmon | 102/463 |
| 2,682,222 | 6/1954 | Richardson et al. | 102/463 |
| 2,951,286 | 4/1952 | Paulve | 102/462 |
| 3,055,302 | 9/1962 | Bayard et al. | 102/463 |
| 3,215,075 | 11/1965 | Bayard et al. | 102/462 |
| 3,352,239 | 11/1967 | Schinnerer et al. | 102/463 |
| 3,442,214 | 5/1969 | Huskins | 102/463 |
| 3,673,965 | 7/1972 | Herter | 102/462 |
| 3,688,699 | 9/1972 | Horn et al. | 102/462 |

FOREIGN PATENT DOCUMENTS

| | | | |
|---|---|---|---|
| 2245926 | 4/1975 | France | 102/462 |
| 0064641 | 3/1942 | Norway | 102/463 |
| 2042693 | 9/1980 | United Kingdom | 102/462 |

*Primary Examiner*—Harold J. Tudor

*Attorney, Agent, or Firm*—John R. Wahl

[57] ABSTRACT

A moisture seal is designed for a shotshell having a biaxially oriented plastic tubular body. The seal is a composite of a thermally conductive layer and a thermoplastic such as high density polyethylene laminated together. The rim portion of the inner layer of high density polyethylene is bonded or fused to the tubular body to seal the shot load end without destroying the biaxial orientation of the tubular body adjacent the rim portion. The moisture seal may be installed inside the tubular body and fused to the inside surface of the tubular wall or may be installed in place of or over the end closure and fused to the outside surface of the tubular body.

37 Claims, 2 Drawing Sheets

MOISTURE SEAL SHOTSHELLS

This invention relates generally to shotshells and more particularly to a moisture seal for the end closure over the load of shot.

In the past, many methods of adhering a paper disk over the end of a crimped closed shotshell have been advanced. A paper disk with an adhesive to stick the paper disk over the crimp or injection of a dough-like material into the star crimped end closure are methods that have been typically used with waxed paper cased shotshells. U.S. Pat. Nos. 2,336,065, 2,373,554, 2,387,665, 2,393,987, and 2,682,222 are examples of such methods.

With the introduction of plastic tubular shotshell cases, several different methods have been proposed. In U.S. Pat. No. 3,055,302, a polyethylene plug is friction sealed into the central hole in the star crimp by spin welding. This arrangement provides a rather strong, thick and solid end closure but may adversely affect the reloadability of such a casing.

Another example, U.S. Pat. No. 3,442,214 utilizes a rather thick, over shot card 9 of granulated cork impregnated with paraffin wax. The impregnated cork over shot card may provide a moisture seal over the shot; however, it introduces a substantial parasitic weight to the load.

It is therefore an object of the present invention to provide a simple, light weight moisture seal for the end of a shotshell that introduces minimal parasitic load.

It is another object of the present invention to provide a moisture seal for a shotshell which hermetically seals the crimped end of the shotshell.

It is a still further object of the present invention to provide a moisture seal on a plastic shotshell case of biaxially oriented thermoplastic material which does not destroy the biaxial orientation of the case.

It is a still further object of the present invention to provide a moisture seal for a shotshell which may be ejected from the shotshell case through the barrel.

It is a still further object of the present invention to provide a moisture seal for a shotshell that has no adverse impact on the shot pattern.

It is a still further object of the present invention to provide a moisture seal for a shotshell which eliminates frangible particles of the seal from being deposited in the action of the shotgun.

The shotshell moisture seal in accordance with the present invention, in its simplified form, is a thin disk shaped member extending radially across the end of the tubular shotshell body. An annular rim portion of the end seal, of a thermoplastic material, is fused to the tubular body of the shotshell while maintaining the overall biaxial orientation of the shotshell body adjacent the rim portion.

One preferred embodiment of the moisture seal in accordance with the present invention comprises a circular disk of a composite material made of a circular disk outer layer of metal foil or other thermally conductive material laminated to a circular inner layer of thermoplastic material of preferably the same type as the tubular body such as high density polyethylene. The annular rim portion may also extend axially to forming a shallow cup shaped cap with the thermally conductive layer facing outward which fits over the end of the shotshell. In this case the annular rim portion of the inner layer is fused to the outside surface of the shotshell body.

Another embodiment may comprise an annular disk of metal foil laminated to a circular disk of thermoplastic material. A further embodiment may comprise a circular disk of metal foil laminated to an annular disk of thermoplastic material. Finally, the seals according to the invention may be installed over the end closure or under the end closure of the shotshell.

Alternatively, a seal in accordance with the present invention may be installed in place of an end closure of the shotshell. In other words, the seal itself may be used as the end closure of the shotshell. The thermoplastic layer of the seal may be any olefinic polymer or copolymer and is preferably a high density polyethylene.

For external installation, a conventional shotshell is loaded in a conventional manner, and crimped closed. The seal in accordance with present invention is then placed over the crimped end of the shotshell with the rim portion of the seal preferably being against the shoulder where the star shaped crimp and the axial portion of the tubular wall join. The annular rim portion of the seal may extend downward over the shoulder a short distance along the outside surface of the tubular wall.

Alternatively, if a crimp closure is not desired, the seal may be simply placed over the open end of the shotshell. The following description applies similarly except that the rim portion of the seal abuts with the end of the shotshell wall rather than the shoulder.

A controlled amount of heat is applied to the periphery of the outer layer of metal foil which thus melts the adjacent polyethylene of the inner layer, fusing an annular portion of the inner layer at or adjacent the shoulder of the tubular body of the shell casing formed at the end closure. The application of heat is closely controlled so as to just fuse the rim portion of the inner layer of the seal and a very thin surface portion of the outer wall surface of the tubular casing together at or adjacent the shoulder so that the biaxial orientation of the tubular casing is not destroyed, yet sufficient to provide a hermetic seal. The heat may be applied with any appropriately shaped heating tool preferably having a conical cup or trumpet shaped head to fit over the circular shoulder of the crimped end of the shotshell.

The outer layer of the seal, preferably made of a metal foil such as aluminum or an aluminized mylar, prevents the bonding of the inner layer to the heating tool. When the heating tool is removed and the end seal is allowed to cool, a permanent fused seal is secured across the crimped end of the shotshell.

The second embodiment of the end seal in accordance with the present invention is a variation of the above in which the outer layer remains a circular disk of metal foil laminated to an inner annular disk of polyethylene. Heat is applied in the same manner to bond the polyethylene of the annular inner layer to the shoulder of crimped shotshell. In this embodiment, the circular metal foil layer is stretched across the closed and crimped end of the shotshell to form the seal.

The third embodiment of the present invention is another variation in which the outer layer of the seal composite is an annular disk of metal foil and the inner layer being a circular disk of polyethylene. Installation of the seal is the same as previously described, with the end result being a layer of polyethylene stretched across the end closure of the shotshell. As in the other embodiments, the periphery of the polyethylene disk is fused to the circular shoulder of the end closure of the tubular casing.

For internal installation, a fourth embodiment of the present invention is a generally circular seal designed to be installed within the tubular casing of the shotshell prior to crimping the open end of the case closed. The seal is a circular composite disk having a diameter greater than that of the shotshell case. The composite disk has an outer annular disk layer of metal foil laminated to an inner circular disk layer of polyethylene. The composite disk is positioned inside the open end of the tubular shotshell casing adjacent the load of shot by a plunger die. The seal is sized slightly larger that the inside diameter of the tubular casing so that when the plunger die inserts the seal, a portion of the rim portion of the seal is deformed in a coaxial direction into a tubular portion which frictionally bears against the inside surface of the tubular wall of the tubular casing. Heat is then applied to the periphery of the plunger to fuse the tubular portion of the rim portion to the inside surface of the tubular shotshell casing. A conventional star crimp end closure is then formed over the seal in a conventional manner. This embodiment has the advantage that when the shotshell is fired the wad and shot structure forces the seal materials out through the barrel with the shot and wad.

As in the first three embodiments described above, the physical configuration of the fourth embodiment may be varied. For example, a fifth embodiment of the seal is a composite disk which has a circular outer layer and a circular inner layer laminated together to form the seal composite. In a still further embodiment, the metal foil outer layer may be a circular disk and the inner layer of polyethylene may be an annular disk similar to the second embodiment described above.

In all of the embodiments described above a critical feature is that the heat applied is controlled in such a manner as to prevent the overall destruction of biaxial orientation of the polyethylene in the tubular case wall. Only a small surface layer portion of the tubular wall is fused together with polyethylene inner layer of the seal. Thus only the biaxial orientation of this surface layer is disturbed. The overall biaxial orientation of the tubular wall remains intact. In this way, the effective strength of the tubular case is maintained. Reloadability of the shotshell casing is also not impaired especially with the seal inserted and installed inside the shotshell casing as in the fourth and fifth embodiments.

Figure 1:
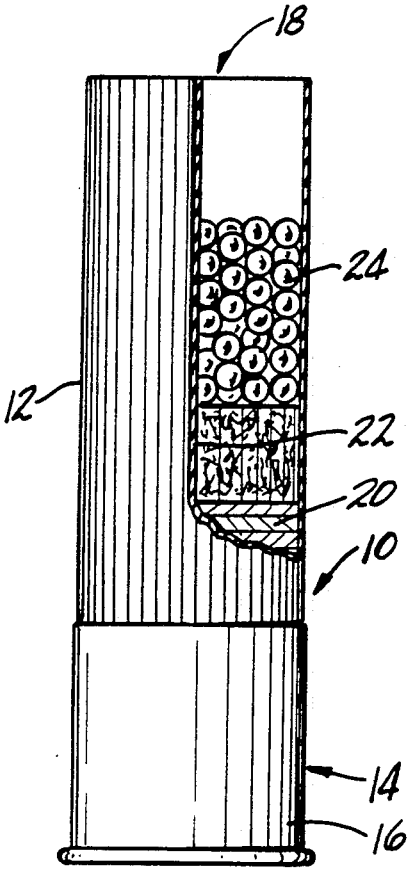
FIG. 1 is an elevational view of a shotshell, prior to crimping and sealing the open end having portions of the shotshell casing broken away.

A shotshell 10 having a tubular body 12 and having a head end 14 usually closed with a metal rimmed end head 16 and an opposite, open end 18 is shown in FIG. 1. The shotshell 10 is shown loaded with a propellant 20, a wad structure 22, and a load of lead or steel shot 24.

The tubular body 12 is made of a biaxially oriented high density polyethylene plastic material and is illustrated in FIG. 1 prior to the installation of an end closure at open end 18. The end closure for open end 18 may comprise a conventional star shaped crimp arrangement with the end of tubular body 12 folded inward, a roll crimp (not shown), or may be eliminated entirely, as the seals in accordance with the present invention which are described below may replace such an end closure. It is to be understood from the following description of the preferred embodiments that various physical arrangements of end closures may be utilized in place of the star crimp end closure illustrated without departing from the scope and fair meaning of the description of the invention. Further, like numerals are utilized where appropriate to refer to like components or physical fractures in the following description of the preferred embodiments.

Figure 2:
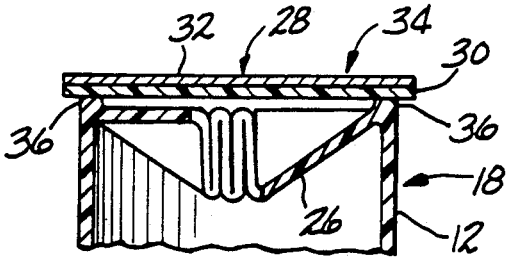
FIG. 2 is a vertical sectional view of a portion of the shotshell in FIG. 1 after crimping the open end, with a first embodiment of a moisture seal in accordance with the present invention positioned thereover.
Figure 3:
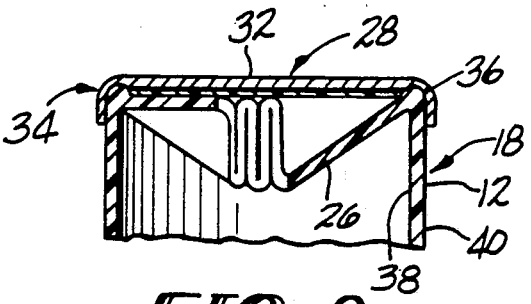
FIG. 3 is a vertical sectional view as in FIG. 2 with the seal in accordance with the present invention fused to the crimped end closure of the shotshell.

An enlarged partial sectional view of the open end 18 of the shotshell 10 shown in FIG. 1 is illustrated in FIGS. 2 and 3 with a star crimped end closure 26 closing open end 18. A moisture seal 28 in accordance with a first embodiment of the present invention is shown positioned over the end closure 26. The moisture seal as illustrated in the Figures is greatly enlarged so as to illustrate the features of the present invention. The actual thickness of the seal is on the order of a few mils.

The seal 28 in accordance with the first embodiment of the present invention comprises a composite disk having an inner layer 30 and an outer layer 32. The inner layer 30 is preferably made of the same material as is the tubular body 12, i.e. high density polyethylene and may also include a copolymer additive such as polyvinyl acetate. Alternatively, inner layer 30 may be an appropriate thermally activated adhesive. The outer layer 32, on the other hand, may be a metal foil such as aluminium or other flexible material that is thermally conductive and will not adhere to the application tool when heated.

The moisture seal 28 is pressed against the end closure 26 of the tubular body 12 so that the inner layer 30 contacts the circular shoulder 36 and folds thereover. Controlled heat is then applied to the rim portion 34 of the moisture seal 28. The controlled application of heat causes inner layer 30 of the rim portion 34 to melt, fusing the moisture seal 28 to the circular shoulder 36 as illustrated in FIG. 3. As the tubular body 12 has an inner wall surface 38 and an outer wall surface 40, the rim portion 34 of the moisture seal 28 is thus actually fused to the outer wall surface 40 and adjacent at shoulder 36. The diameter of the seal 28 may be greater than that of tubular body 12 so as to fold thereover as shown or may be the same as body 12. In the latter case, bonding would take place primarily at shoulder 36.

The amount of heat applied to the moisture seal 28 in bonding or fusing the rim portion 34 to the outer wall surface 40 of tubular body 12 at or adjacent shoulder 36 is critical to proper functioning of the seal in accordance with the present invention. Sufficient heat must be provided to fuse the inner layer 30 to the outer layer wall surface 40. However, the amount of heat added must not be sufficient to destroy the biaxially orientation of the tubular body 12. Otherwise, the strength of the tubular body 12 at the location of shoulder 36 of end closure 26 will be weakened. The use of of a composite seal material comprising an inner layer 30 and a outer layer 32 of metal foil allows the precise application of heat to the rim portion 34 while at the same time preventing adherence of the outer layer 32 to the tool with which the heat is applied.

Figure 4:
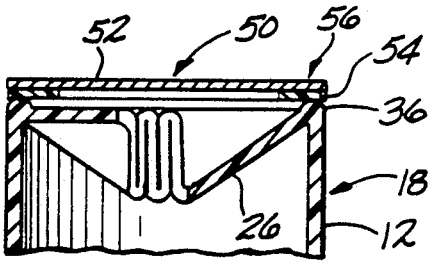
FIG. 4 is a partial sectional view of a second embodiment of the seal in accordance with the present invention positioned over the crimped end closure of the shotshell shown in FIG. 1.
Figure 4A:
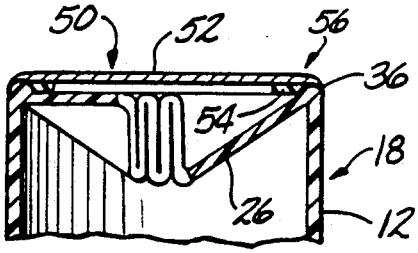
FIG. 4A is the same sectional view of the end closure of the shotshell as shown in FIG. 4 with the second embodiment of the seal in accordance with the present invention fused thereto.
Figure 6:
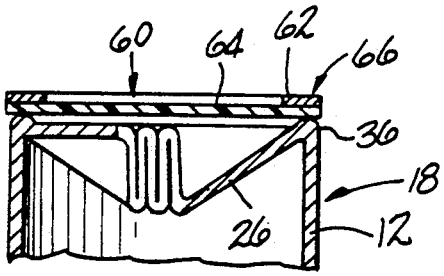
FIG. 6 is a vertical sectional view of a portion of the shotshell in FIG. 1 after crimping the open end, with a third embodiment of the seal in accordance with the present invention positioned over the crimped end of the shotshell.
Figure 7:
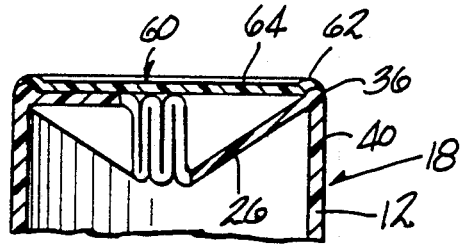
FIG. 7 is a partial sectional view of the shotshell as shown in FIG. 6 with the third embodiment of the seal in accordance with the present invention fused to the rime of the crimped end closure.
Figure 8:
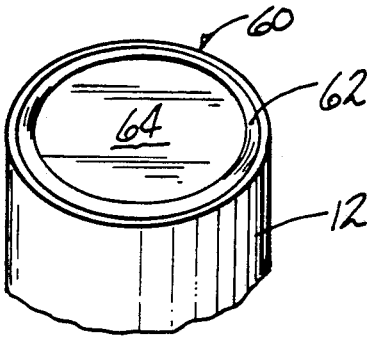
FIG. 8 is a partial end perspective view of the shotshell sealed in accordance with the third embodiment of the present invention as shown in FIG. 7.
Figure 9:
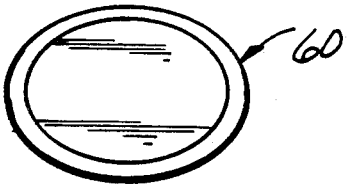
FIG. 9 is a separate perspective view of the third embodiment of the seal according to the present invention shown in FIG. 6.

A second embodiment of the present invention is illustrated in FIGS. 4 and 4A. Once again, open end 18 has been closed by an end closure 26 which consists of a star shaped crimp portion of tubular body 12. In this second embodiment, the end seal 50 is a composite made of a circular disk outer layer 52 of aluminium foil and an annular disk inner layer 54 of high density polyethylene laminated together. As in the first embodiment, a rim portion 56 of the seal 50 is thermally bonded to the shoulder 36 by melting the polyethylene of the inner layer 54 and fusing the inner layer 54 to the outer wall surface 40 at the shoulder 36. Seal 50 is shown installed and bonded to the tubular body 12 in FIG. 4A. The moisture seals in accordance first and second embodiments of the present invention provide a flat circular metal foil disk extending radially across the end closure 26 of the tubular body 12. The seal also presents a smooth, flat metal foil outer end surface contour to the crimped shotshell as shown in FIG. 5.

Figure 5:
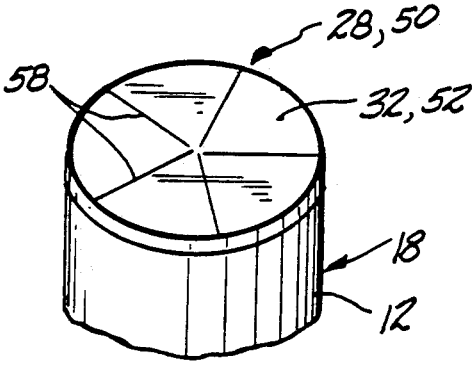
FIG. 5 is a perspective end view of the shotshell sealed in accordance with either the first or the second embodiments of the present invention as shown in FIGS. 3 and 4A.

During seal installation, the seal 50 may be pressed onto the end closure 26 to eliminate any gap therebetween rather than present a flat outer surface as shown in FIGS. 4A and 5. In this case, the installed seal would leave a slightly recessed appearance.

In addition, score lines 58 may be formed in outer layer 52 of seal 50. These score lines direct the tearing open of seal 50 upon firing the shotshell 10 along predetermined lines. The torn parts of the seal remain attached at the rim and therefore prevents pieces of the seal are prevented from falling into the action of the shotgun. Score lines 58 may be made in each of the embodiments herein described to direct the tearing open of the seal. These score lines may be designed to force the torn seal material to be discharged through the muzzle of the shotgun or to be retained with the shotshell casing.

A seal 60 in accordance with a third embodiment of the present invention is shown in FIGS. 6 through 9. In this embodiment, of the seal 60 comprises an annular disk outer layer 62 metal foil laminated to a circular disk 64 of high density polyethylene. When controlled heat is applied to the rim 66 of annular disk 62, the inner layer is once again fused to the outer wall surface 40 of tubular body 12 at shoulder 36. However, in this embodiment the bulk of the seal is a disk of polyethylene stretching radially across the end closure 26 of the tubular body 12.

Figure 10:
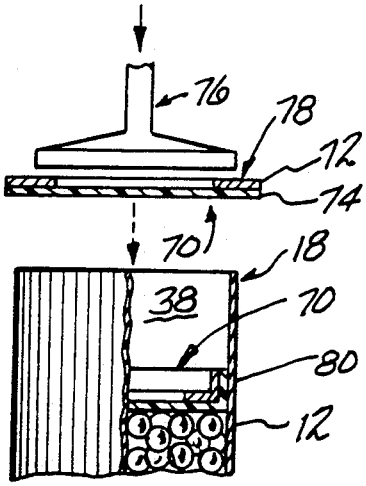
FIG. 10 is a schematic representation of a fourth embodiment of the present invention positioned for installation in and installed within the open end of the shotshell shown in FIG. 1.
Figure 11:
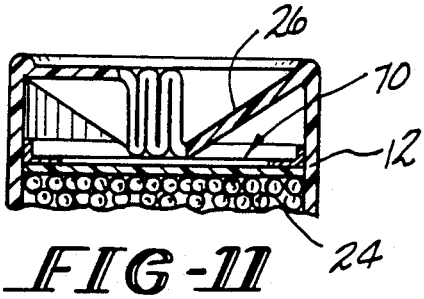
FIG. 11 is a vertical sectional view of a portion of the shotshell shown in FIG. 10 with the fourth embodiment of the seal in accordance with the present invention installed therein and the end closure crimped thereover.

A fourth embodiment of the present invention is illustrated in FIGS. 10 and 11. In this embodiment, a moisture seal 70 has a diameter greater than that of tubular body 12. The moisture seal 70 comprises a composite disk of an outer annular disk layer 72 of metal foil laminated to an inner circular disk layer 74 of high density polyethylene.

When the moisture seal 70 is pressed into the tubular body 12 by an appropriate plunger die 76, a portion of the rim portion 78 is deformed into a tubular shaped portion 80 which frictionally bears against the inner wall surface 38 of the tubular body 12. Heat is then applied around the outer periphery of plunger die 76, thus melting the tubular portion 80 of the polyethylene inner layer 74 thus fusing tubular portion 80 to the inside surface 38 of the tubular body 12. A star crimp end closure 26 may then be formed in a conventional manner as is illustrated in FIG. 11.

In this fourth embodiment, the seal 70 is contained entirely within the tubular body 12. Consequently, upon propellant ignition, the shot 24 and wad structure 22 will substantially strip the seal 70 from the inside of tubular body 12 and carry it through the barrel without leaving any debris behind which could interfere with the mechanical action of the shotgun. As the seal 70 is extremely thin, little parasitic weight will be added to the accelerated load. Accordingly, negligible effect on shot pattern and ballistics is anticipated.

Figure 12:
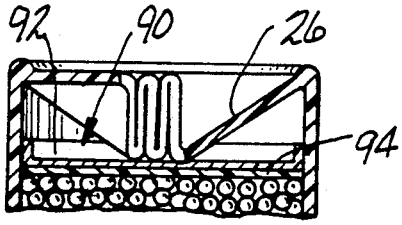
FIG. 12 is a sectional view as in FIG. 11 having a fifth embodiment of the present invention installed under the crimped end closure of the shotshell.

FIG. 12 illustrates a fifth embodiment of the present invention which is similar to the fourth embodiment above described. In the fifth embodiment, a seal 90 is a composite made of a circular disk outer layer 92 and laminated to a circular disk inner layer 94. This embodiment, although adding a small additional amount of weight, will provide increased structural strength to the moisture seal due to the presence of a complete disk outer layer 92 in the event that rough handling of the shotshell is anticipated.

Figure 13:
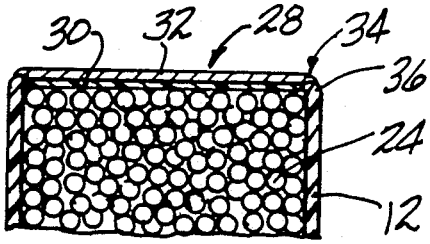
FIG. 13 is a sectional view as in FIG. 3 except that the seal is placed over the open end of the shotshell shown in FIG. 1 without a crimped end closure.

Finally, FIG. 13 illustrates another alternative embodiment of the seal in accordance with the present invention without the end closure 26. This seal in this alternative may be as described above and illustrated in FIGS. 2 through 9. As shown in FIG. 13, seal 28 is installed over the end 18 of the shotshell 10. No open space over the load of shot 24 is required for the end closure 26. Instead, the rim portion 34 of seal 28 is fused or bonded to shoulder 36 which, in this case, is simply the open end of the tubular casing 12.

Widely different embodiments of the moisture seal in accordance with the present invention may be made without departing from spirit and the scope thereof. It is to be understood that this invention is not limited to the specific embodiments illustrated except as defined in the appended claims.

While the invention has been described above with reference to specific embodiments thereof, it is apparent that many changes, modifications and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety.

What is claimed is:

1. In a shotshell having a biaxially oriented tubular plastic body, a head end and an opposite end, an end seal member cover in said opposite end, said member having an annular rim portion of thermoplastic material fused to said tubular body sealing said opposite end while maintaining the overall biaxial orientation of said body adjacent said rim portion.

2. The seal according to claim 1 wherein said rim portion is made of high density polyethylene.

3. In a shotshell having a biaxially oriented tubular plastic body, a head end and an opposite end, a composite end seal metal containing material laminated to an inner layer of thermally activated binding material covering said opposite end, said member having an annular rim portion fused to said tubular body while maintaining the overall biaxial orientation of said body adjacent said rim portion.

4. The seal according to claim 3 wherein said outer layer is a metal foil.

5. The seal according to claim 4 wherein said outer layer is aluminum.

6. The seal according to claim 4 wherein said outer layer is aluminized mylar.

7. The seal according to claim 3 wherein said inner layer comprises an annular rim portion of high density polyethylene fused to said body so as to bond said outer layer of said member thereto, said outer layer closing said opposite end.

8. The seal according to claim 3 wherein said outer layer is a generally circular disk of metal foil and said inner layer is a generally circular disk of high density polyethylene.

9. The seal according to claim 7 wherein said end seal member is positioned inside said tubular body at said opposite end and said rim portion is fused to an inside surface of said tubular body.

10. The seal according to claim 7 wherein said end seal member is positioned over said opposite end and said rim portion is fused to an outside surface of said tubular body.

11. A shotshell having a biaxially oriented plastic tubular body with inner and outer tubular wall surfaces, said body having a head end and an opposite end, an end closure formed at said opposite end and a moisture seal comprising:

a cover member extending across said opposite end, said member having a rim portion of high density polyethylene fused to said body to seal said opposite end while maintaining the biaxial orientation of said body adjacent said rim portion.

12. The seal according to claim 11 wherein said rim portion is fused to the outer wall surface of said tubular body.

13. A moisture seal for a shotshell having a biaxially oriented plastic tubular body with inner and outer tubular wall surfaces, said body having a head end and an opposite end and an end closure at said opposite end, said moisture seal comprising:

a composite cover member having an outer layer of thermally conductive metal containing material laminated to an inner layer of high density polyethylene adapted to extend across said opposite end, said member having a rim portion of high density polyethylene adapted to be fused to said body to seal said opposite end while maintaining the biaxial orientation of said body adjacent said rim portion.

14. The seal according to claim 13 wherein said outer layer is a metal foil.

15. The seal according to claim 14 wherein said outer layer is aluminum.

16. The seal according to claim 14 wherein said outer layer is aluminized mylar.

17. The seal according to claim 13 wherein said inner layer comprises an annular disk of high density polyethylene adapted to be fused to said body so as to bond said outer layer of said member thereto, said outer layer adapted to close said opposite end.

18. The seal according to claim 13 wherein said outer layer is a generally circular disk of metal foil and said inner layer is a generally circular disk of high density polyethylene.

19. The seal according to claim 17 wherein said end seal member is adapted to be positioned inside said tubular body at said opposite end and said rim portion is adapted to be fused to said inside wall surface of said tubular body.

20. The seal according to claim 17 wherein said end seal member is adapted to be positioned over said opposite end and said rim portion is adapted to be fused to said outside wall surface of said tubular body.

21. The seal according to claim 19 wherein said member is adapted to be positioned inside said end closure.

22. The seal according to claim 20 wherein said end seal member is adapted to be positioned outside said end closure.

23. The seal according to claim 13 wherein said rim portion of said seal member further comprises a tubular portion having said inner layer of high density polyethylene adapted to face said inner wall surface and sized to fit against said inside wall surface of said tubular body at said opposite end and inside said end closure.

24. The seal according to claim 23 wherein said outer layer has a central generally flat disk portion extending radially outward across said opposite end.

25. The seal according to claim 24 wherein said outer layer is a metal foil.

26. The seal according to claim 25 wherein said outer layer is aluminum.

27. The seal according to claim 26 wherein said outer layer is aluminized mylar.

28. A shotshell comprising:

a biaxially oriented tubular plastic body having a head end and an opposite end;

a propellant charge contained within said body at said head end;

a wad against said propellant;

a shot load positioned within said body against said wad; and an end seal member covering said opposite end, said seal member having an annular rim portion of thermoplastic material thermally fused to said biaxially oriented tubular plastic body sealing said opposite end and maintaining the overall biaxial orientation of said body adjacent said rim portion.

29. The shotshell according to claim 28 wherein said rim portion is made of high density polyethylene.

30. The shotshell according to claim 28 wherein said member is a composite having an outer layer of thermally conductive metal containing material laminated to an inner layer of thermally activated bonding material.

31. The shotshell according to claim 30 wherein said outer layer is metal foil.

32. The shotshell according to claim 31 wherein said outer layer is aluminum.

33. The shotshell according to claim 31 wherein said outer layer is an aluminized mylar.

34. The shotshell according to claim 30 wherein said inner layer comprises an annular rim portion of high density polyethylene fused to said body so as to bond said outer layer of said member thereto, said outer layer closing said opposite end.

35. The shotshell according to claim 30 wherein said outer layer is a generally circular disk of metal foil and said inner layer is a generally circular disk of high density polyethylene.

36. The shotshell according to claim 34 wherein said end seal member is positioned inside said tubular body at said opposite end and said rim portion is fused to an inside surface of said tubular body.

37. The shotshell according to claim 34 wherein said end shell member is positioned over said opposite end and said rim portion is fused to an outside surface of said tubular body.

* * * * *

UNITED STATES PATENT AND TRADEMARK OFFICE

CERTIFICATE OF CORRECTION

PATENT NO. : 4,991,512

DATED : February 12, 1991

INVENTOR(S) : Rodney Van Wyk

It is certified that error appears in the above—identified patent and that said Letters Patent is hereby corrected as shown below:

At column 7, line 18, please delete "cover in" and insert ---covering--- in its place.

At column 7, line 27, after "end seal", please insert ---member having an outer layer of thermally conductive ---.

At column 7, line 28, please delete "binding" and insert ---bonding--- in its place.

At column 10, line 15, please delete "shell" and insert ---seal--- in its place.

Signed and Sealed this

Eleventh Day of August, 1992

*Attest:*

DOUGLAS B. COMER

*Attesting Officer*

*Acting Commissioner of Patents and Trademarks*